US010339848B2

(12) United States Patent
Park et al.

(10) Patent No.: US 10,339,848 B2
(45) Date of Patent: Jul. 2, 2019

(54) DISPLAY APPARATUS WITH MULTIPLE POWER MODES AND ELECTRONIC SYSTEM INCLUDING THE SAME

(71) Applicant: SAMSUNG DISPLAY CO., LTD., Yongin-si, Gyeonggi-do (KR)

(72) Inventors: Mun-San Park, Hwaseong-si (KR); Joon-Chul Goh, Hwaseong-si (KR); Woo-Mi Bae, Daegu (KR); Kyoung-Won Lee, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 538 days.

(21) Appl. No.: 14/993,494

(22) Filed: Jan. 12, 2016

(65) Prior Publication Data

US 2016/0351103 A1 Dec. 1, 2016

(30) Foreign Application Priority Data

May 29, 2015 (KR) ..... 10-2015-0076387

(51) Int. Cl.
*G09G 5/10* (2006.01)
*G09G 3/20* (2006.01)

(52) U.S. Cl.
CPC ... *G09G 3/2007* (2013.01); *G09G 2320/0247* (2013.01); *G09G 2330/021* (2013.01); *G09G 2360/16* (2013.01)

(58) Field of Classification Search
CPC ..... G09G 3/2007; G09G 2320/0247; G09G 2330/021; G09G 2360/16
USPC ..... 345/691
See application file for complete search history.

(56) References Cited

U.S. PATENT DOCUMENTS

2012/0194536 A1* 8/2012 Pyo ..... G09G 3/342 345/589
2013/0082607 A1* 4/2013 Gandhi ..... G09G 3/3413 315/153
2013/0201226 A1* 8/2013 Wu ..... G09G 5/10 345/690
2013/0241938 A1* 9/2013 Gruber ..... G06T 15/005 345/501

(Continued)

FOREIGN PATENT DOCUMENTS

JP 2013-051652 3/2013
KR 1020090032262 4/2009
KR 1020090096999 9/2009

*Primary Examiner* — Jonathan M Blancha
(74) *Attorney, Agent, or Firm* — F. Chau & Associates, LLC

(57) ABSTRACT

A display apparatus includes a display panel and a timing controller. The timing controller generates first output image data based on input image data and sets a driving frequency of the display panel as a first frequency in a first operation mode. The timing controller converts the input image data into second output image data and sets the driving frequency of the display panel as a second frequency lower than the first frequency in a second operation mode. The display panel displays a first image based on the first frequency and the first output image data in the first operation mode. The first image is represented by X grayscales. The display panel displays a second image based on the second frequency and the second output image data in the second operation mode. The second image is represented by Y grayscales, where Y is less than X.

16 Claims, 13 Drawing Sheets

(56) References Cited

U.S. PATENT DOCUMENTS

| | | | | |
|---|---|---|---|---|
| 2014/0092440 | A1 | 4/2014 | Misaizu et al. | |
| 2014/0240366 | A1* | 8/2014 | Lee | G09G 3/2033 345/690 |
| 2015/0365621 | A1* | 12/2015 | Zhang | G09G 5/005 348/791 |

* cited by examiner

| REPRESENTATIVE GRAYSCALES / PARTIAL IMAGES | GREP1 | GREP2 | GREP3 | GREP4 | GREP5 | GREP6 | GREP7 | GREP8 |
|---|---|---|---|---|---|---|---|---|
| PI1 | 0 | 32 | 43 | 81 | 89 | 130 | 139 | 162 |
| PI2 | 0 | 32 | 43 | 77 | 81 | 89 | 130 | 162 |
| PI3 | 0 | 32 | 43 | 83 | 112 | 128 | 151 | 162 |
| PI4 | 0 | 32 | 43 | 83 | 90 | 112 | 141 | 162 |

DISPLAY APPARATUS WITH MULTIPLE POWER MODES AND ELECTRONIC SYSTEM INCLUDING THE SAME

CROSS-REFERENCE TO RELATED APPLICATION

This application claims priority under 35 USC § 119 to Korean Patent Application No. 10-2015-0076387, filed on May 29, 2015 in the Korean Intellectual Property Office (KIPO), the contents of which are herein incorporated by reference in their entirety.

TECHNICAL FIELD

Exemplary embodiments relate generally to display systems, and more particularly to display apparatuses that are used as one of input/output (I/O) devices and electronic systems including the display apparatuses.

DESCRIPTION OF THE RELATED ART

A liquid crystal display apparatus is a type of flat panel display (FPD), which is widely used in recent years. The FPD may include, but are not limited to, a liquid crystal display (LCD), a plasma display panel (PDP) and an organic light emitting display (OLED), for example.

The display apparatuses can be used in various electronic systems, such as a mobile phone, a smart phone, a tablet computer, a personal digital assistant (PDA), etc. As more capabilities and features are added to mobile devices their power consumption increases limiting performance.

SUMMARY

At least one exemplary embodiment of the present disclosure provides an electronic system including a display apparatus.

According to exemplary embodiments, a display apparatus includes a display panel and a timing controller. The timing controller generates first output image data based on input image data and sets a driving frequency of the display panel as a first frequency in a first operation mode. The timing controller converts the input image data into second output image data and sets the driving frequency of the display panel as a second frequency lower than the first frequency in a second operation mode. The display panel displays a first image based on the first frequency and the first output image data in the first operation mode. The first image is represented by X grayscales, where X is a natural number equal to or greater than two. The display panel displays a second image based on the second frequency and the second output image data in the second operation mode. The second image is represented by Y grayscales, where Y is a natural number less than X.

In an example embodiment, the display panel may display the second output image data based on a frame masking driving (FMD) scheme where every second frame of the input image data is blocked from the display.

In an example embodiment, the display apparatus may further include a data driver. The data driver may generate a plurality of data voltages based on one of the first output image data and the second output image data and to apply the plurality of data voltages to the display panel.

In an example embodiment, the display apparatus may further include a gate driver. The gate driver may generate a plurality of gate signals based on one of the first output image data and the second output image data and to apply the plurality of gate signals to the display panel.

In an example embodiment, the timing controller may include an image compensator, an image divider, an image analyzer, a grayscale selector and an image converter. The image compensator may generate the first output image data based on the input image data in the first operation mode. The image divider may generate a plurality of partial image data by dividing the input image data in the second operation mode. Each frame of the input image data is divided into a plurality of partial image data. The image analyzer may generate a plurality of grayscale histograms based on each partial image data of the plurality of partial image data. The grayscale selector may determine a plurality of representative grayscales for each partial image data of the plurality of partial image data based on the grayscale histograms for each partial image data and a plurality of reference grayscales. The image converter may generate the second output image data based on the plurality of partial image data and the plurality of representative grayscales.

A flicker level of the display panel may be lower than a reference flicker level when the display panel displays an image represented by the plurality of reference grayscales. The plurality of representative grayscales may be included in the plurality of reference grayscales.

In an example embodiment, the plurality of partial images may include a first partial image. The image divider may generate first partial image data corresponding to the first partial image. The image analyzer may generate a first grayscale histogram based on the first partial image data. The grayscale selector may determine first representative grayscales based on the first grayscale histogram and the plurality of reference grayscales. The image converter may generate a first part of the second output image data based on the first partial image data and the first representative grayscales.

In an example embodiment, the grayscale selector may select Z grayscales as the representative grayscales for each partial image data of the plurality of partial image data, where Z is a natural number equal to or less than Y. The Z grayscales may indicate majority grayscales among the plurality of reference grayscales in the grayscale histogram for each partial image data of the plurality of partial image data. The image converter may convert each of a plurality of grayscales for each partial image data of the plurality of partial image data into a respective one of the representative grayscales for each partial image data of the plurality of partial image data.

In an example embodiment, the plurality of partial images may include a second partial image. The image divider may generate second partial image data corresponding to the second partial image. The image analyzer may generate a second grayscale histogram based on the second partial image data. The grayscale selector may determine second representative grayscales based on the second grayscale histogram and the plurality of reference grayscales. The image converter may generate a second part of the second output image data based on the second partial image data and the second representative grayscales. Some of the second representative grayscales may be included in the first representative grayscales, and others of the second representative grayscales may be not included in the first representative grayscales.

In an example embodiment, the timing controller may further include a storage device. The storage may store the plurality of reference grayscales.

In an example embodiment, the timing controller may further include a reference grayscale setting unit. The reference grayscale setting unit may determine the plurality of reference grayscales based on flicker levels obtained from an external flicker measurement device.

In an example embodiment, the timing controller may further include a driving frequency setting unit. The driving frequency setting unit may set the driving frequency of the display panel as the first frequency in the first operation mode and may set the driving frequency of the display panel as the second frequency in the second operation mode.

The timing controller may receive a mode selection signal that selectively enables the first operation mode or the second operation mode.

According to exemplary embodiments, an electronic system includes a display apparatus and a processor. The display apparatus includes a display panel and a timing controller. The processor controls an operation of the display apparatus. The timing controller generates first output image data based on input image data and sets a driving frequency of the display panel as a first frequency in a first operation mode. The timing controller converts the input image data into second output image data and sets the driving frequency of the display panel as a second frequency lower than the first frequency in a second operation mode. The display panel displays a first image based on the first frequency and the first output image data in the first operation mode. The first image is represented by X grayscales, where X is a natural number equal to or greater than two. The display panel displays a second image based on the second frequency and the second output image data in the second operation mode. The second image is represented by Y grayscales, where Y is a natural number less than X.

In an example embodiment, the display panel may display the second output image data based on a frame masking driving (FMD) scheme where every second frame of the input image data is blocked from the display.

In an example embodiment, the display apparatus may further include a data driver. The data driver may generate a plurality of data voltages based on one of the first output image data and the second output image data to apply the plurality of data voltages to the display panel.

In an example embodiment, the display apparatus may further include a gate driver. The gate driver may generate a plurality of gate signals based on one of the first output image data and the second output image data and to apply the plurality of gate signals to the display panel.

In an example embodiment, the timing controller may include an image compensator, an image divider, an image analyzer, a grayscale selector and an image converter. The image compensator may generate the first output image data based on the input image data in the first operation mode. The image divider may generate a plurality of partial image data by dividing the input image data in the second operation mode. Each frame of the input image data is divided into a plurality of partial image data. The image analyzer may generate a plurality of grayscale histograms based on each partial image data of the plurality of partial image data. The grayscale selector may determine a plurality of representative grayscales for each partial image data of the plurality of partial image data based on the grayscale histograms for each partial image data and a plurality of reference grayscales. The image converter may generate the second output image data based on the plurality of partial image data and the plurality of representative grayscales.

In an example embodiment, the plurality of partial images may include a first partial image. The image divider may generate first partial image data corresponding to the first partial image. The image analyzer may generate a first grayscale histogram based on the first partial image data. The grayscale selector may determine first representative grayscales based on the first grayscale histogram and the plurality of reference grayscales. The image converter may generate a first part of the second output image data based on the first partial image data and the first representative grayscales. The grayscale selector may select Z grayscales as the first representative grayscales, where Z is a natural number equal to or less than Y. The Z grayscales may indicate majority grayscales among the plurality of reference grayscales in the first grayscale histogram. The image converter may convert each of a plurality of grayscales for the first partial image data into a respective one of the first representative grayscales.

The processor may generate a mode selection signal that selectively enables the first operation mode or the second operation mode to apply the mode selection signal to the timing controller.

According to an exemplary embodiment for operating a timing controller including receiving an input image data, a mode selection signal and selecting one of a first and a second operation mode based on the mode selection signal. A first operation mode includes, generating a first output image data based on the input image data in the first operation mode, wherein the first output image data may be image data that is substantially the same as the input image data. A second operation mode includes generating a partial image data by dividing input image data, generating grayscale histograms based on partial image data, determining representative grayscales based on grayscale histograms and reference grayscales and generating second output image data based on partial image data and representative grayscales. Generating a frequency signal indicating the driving frequency of the display panel based on the mode selection signal. Receiving an input control signal and generating a first control signal for a gate driver and a second control signal for a data driver based on the input control signal.

In an exemplary embodiment wherein the second operation mode further includes blocking, based on a frame masking driving (FMD) scheme, every second frame of the input image data and setting the driving frequency of the display panel to be a reciprocal of a period of two successive image frames.

In an exemplary embodiment wherein the second operation mode further includes blocking, based on a frame masking driving (FMD) scheme, every second and third frame of the input image data and setting the driving frequency of the display panel to be a reciprocal of a period of three successive image frames.

In an exemplary embodiment wherein the second operation mode further includes dividing each frame of the input image data into a plurality of partial image date; and the each frame may be divided into I-by-J partial images, where I and J are natural numbers.

DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
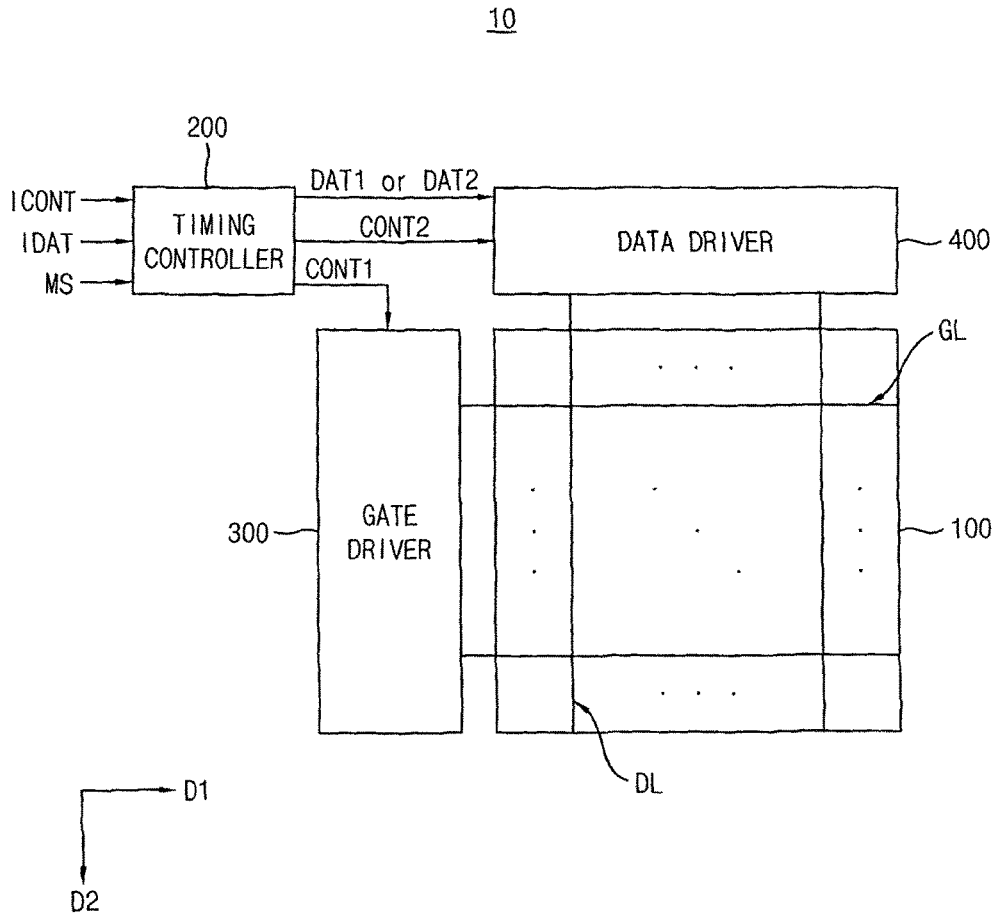
FIG. 1 is a block diagram illustrating a display apparatus according to exemplary embodiments.

Various exemplary embodiments will be described more fully with reference to the accompanying drawings, in which embodiments are shown. This inventive concept may, however, be embodied in many different forms and should not be construed as limited to the embodiments set forth herein. Like reference numerals refer to like elements throughout this application.

FIG. 1 is a block diagram illustrating a display apparatus according to exemplary embodiments.

Referring to FIG. 1, a display apparatus 10 includes a display panel 100, a timing controller 200, a gate driver 300 and a data driver 400.

The display panel 100 is connected to a plurality of gate lines GL and a plurality of data lines DL. The display panel 100 displays an image represented by a plurality of grayscales based on first output image data DAT1 or second output image data DAT2. The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a respective one of the gate lines GL and a respective one of the data lines DL.

Each pixel may include a switching element, a liquid crystal capacitor and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 controls an operation of the display panel 100 and controls operations of the gate driver 300 and the data driver 400. The timing controller 200 receives input image data IDAT, an input control signal ICONT and a mode selection signal MS from an external device (e.g., a host). The input image data IDAT may include a plurality of input pixel data for the plurality of pixels. Each input pixel data may include red grayscale data R, green grayscale data G and blue grayscale data B for a respective one of the plurality of pixels. The input control signal ICONT may include a master clock signal, a data enable signal, a vertical synchronization signal, a horizontal synchronization signal, etc. The mode selection signal MS may selectively enable a first operation mode or a second operation mode.

The timing controller 200 generates the first or second output image data DAT1 or DAT2, a first control signal CONT1 and a second control signal CONT2 based on the input image data IDAT, the input control signal ICONT and the mode selection signal MS.

For example, the timing controller 200 may generate the first or second output image data DAT1 or DAT2 based on the input image data IDAT. The timing controller 200 may generate the first control signal CONT1 based on the input control signal ICONT and the mode selection signal MS. The first control signal CONT1 may be provided to the gate driver 300. A driving timing of the gate driver 300 may be controlled based on the first control signal CONT1. The first control signal CONT1 may include a vertical start signal, a gate clock signal, etc. The timing controller 200 may generate the second control signal CONT2 based on the input control signal ICONT and the mode selection signal MS. The second control signal CONT2 may be provided to the data driver 400. A driving timing of the data driver 400 may be controlled based on the second control signal CONT2. The second control signal CONT2 may include a horizontal start signal, a data clock signal, a data load signal, a polarity control signal, etc.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The data driver 400 receives the second control signal CONT2 and the output image data DAT1 or DAT2 from the timing controller 200. The data driver 400 generates a plurality of data voltages (e.g., analog data voltages) based on the second control signal CONT2 and the output image data DAT1 or DAT2 (e.g., digital image data). The data driver 400 may apply the plurality of data voltages to the data lines DL.

In some exemplary embodiments, the data driver 400 may include a shift register, a latch, a signal processor and a buffer. The shift register may output a latch pulse to the latch. The latch may temporarily store the output image data, and may output the output image data to the signal processor. The signal processor may generate the analog data voltages based on the digital output image data and may output the analog data voltages to the buffer. The buffer may output the analog data voltages to the data lines DL.

In some exemplary embodiments, the gate driver 300 and/or the data driver 400 may be disposed, e.g., directly mounted, on the display panel 100, or may be connected to the display panel 100 in a tape carrier package (TCP) type. Alternatively, the gate driver 300 and/or the data driver 400 may be integrated on the display panel 100.

The display apparatus 10 according to exemplary embodiments may operate one of the first operation mode and the second operation mode based on the mode selection signal MS. In the first operation mode, the timing controller 200 generates the first output image data DAT1 based on the input image data IDAT and sets a driving frequency of the display panel 100 as a first frequency. The display panel 100 displays a first image based on the first frequency and the first output image data DAT1 in the first operation mode. The first image is represented by X grayscales, where X is a natural number equal to or greater than two. In the second operation mode, the timing controller 200 converts the input image data IDAT into the second output image data DAT2 and sets the driving frequency of the display panel 100 as a second frequency lower than the first frequency. The display panel 100 displays a second image based on the second frequency and the second output image data DAT2 in the second operation mode. The second image is represented by Y grayscales, where Y is a natural number less than X.

The first operation mode may be referred to as a normal operation mode or a high frequency mode. The second operation mode may be referred to as a low power mode or a low frequency mode. The first image may be a high quality image that is displayed based on a relatively high driving frequency and is represented by a relatively large number of grayscales. The second image may be a low quality image that is displayed based on a relatively low driving frequency and is represented by a relatively small number of grayscales. The display apparatus 10 according to exemplary embodiments may display the low quality image based on the relatively low driving frequency in the low power mode, and thus may have a relatively low power consumption.

Figure 2A:
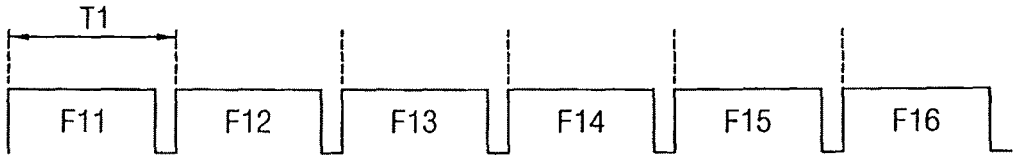
FIGS. 2A, 2B and 2C are waveform diagrams for describing an operation of the display apparatus according to exemplary embodiments.
Figure 2B:
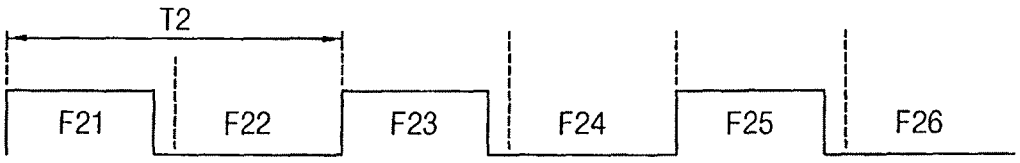
Figure 2C:
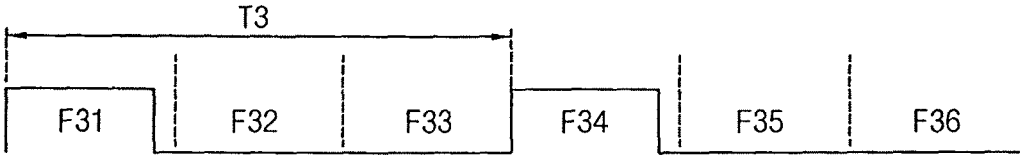

FIGS. 2A, 2B and 2C are diagrams for describing an operation of the display apparatus according to exemplary embodiments.

Referring to FIGS. 1 and 2A, in the first operation mode, all of a plurality of image frames F11, F12, F13, F14, F15 and F16 (e.g., image frames for displaying the first image) may be displayed on the display panel 100. The driving frequency of the display panel 100 may be a reciprocal of a period T1 of a single image frame (e.g., the frame F11). For example, the period T1 of the single image frame may be about 16.66 ms, and the driving frequency of the display panel 100 (e.g., the first frequency) may be set as about 60 Hz in the first operation mode.

Referring to FIGS. 1, 2B and 2C, in the second operation mode, the display apparatus 10 may operate based on a frame masking driving (FMD) scheme where a display of at least one image frame is blocked. In the FMD scheme, some of the image frames (e.g., image frames for displaying the second image) may be displayed on the display panel 100, and a display of others of the image frames may be blocked.

In some exemplary embodiments, as illustrated in FIG. 2B, frames F21, F23 and F25 may be displayed on the display panel 100, and a display of frames F22, F24 and F26 may be blocked. In other words, an output of one image frame (e.g., the frame F22) of two successive image frames (e.g., the frames F21 and F22) may be blocked. The driving frequency of the display panel 100 may be a reciprocal of a period T2 of two successive image frames (e.g., the frames F21 and F22). For example, the period T2 of the two successive image frames may be about 33.33 ms, and the driving frequency of the display panel 100 (e.g., the second frequency) may be set as about 30 Hz in the second operation mode.

In some exemplary embodiments, as illustrated in FIG. 2C, frames F31 and F34 may be displayed on the display panel 100, and a display of frames F32, F33, F35 and F36 may be blocked. In other words, an output of two image frames (e.g., the frames F32 and F33) of three successive image frames (e.g., the frames F31, F32 and F33) may be blocked. The driving frequency of the display panel 100 may be a reciprocal of a period T3 of three successive image frames (e.g., the frames F31, F32 and F33). For example, the period T3 of three successive image frames may be about 50 ms, and the driving frequency of the display panel 100 (e.g., the second frequency) may be set as about 20 Hz in the second operation mode.

In some exemplary embodiments, at least one image frame for displaying the second image may be blocked in the FMD scheme by blocking an output of the data driver 400. For example, in the case of FIG. 2B, the data driver 400 may output the plurality of data voltages for the frames F21, F23 and F25 and may block an output of the plurality of data voltages for the frames F22, F24 and F26. In the example of FIG. 2C, the data driver 400 may output the plurality of data voltages for the frames F31 and F34 and may block an output of the plurality of data voltages for the frames F32, F33, F35 and F36.

In some exemplary embodiments, at least one image frame for displaying the second image may be blocked in the FMD scheme by blocking an output of the gate driver 300. For example, in the case of FIG. 2B, the gate driver 300 may output the plurality of gate signals for the frames F21, F23 and F25 and may block an output of the plurality of gate signals for the frames F22, F24 and F26. In the example of FIG. 2C, the gate driver 300 may output the plurality of gate signals for the frames F31 and F34 and may block an output of the plurality of gate signals for the frames F32, F33, F35 and F36.

Alternatively, at least one image frame for displaying the second image may be blocked in the FMD scheme by blocking one or both of the output of the data driver 400 and the output of the gate driver 300.

Although not illustrated in FIGS. 2B and 2C, in the second operation mode, the display apparatus 10 may operate based on one of various low frequency driving schemes. For example, in FIG. 2B, the frame F21 may be consecutively displayed on the display panel 100 during the whole period T2 in the second operation mode. In FIG. 2C, the frame F31 may be consecutively displayed on the display panel 100 during the whole period T3 in the second operation mode.

Figure 3:
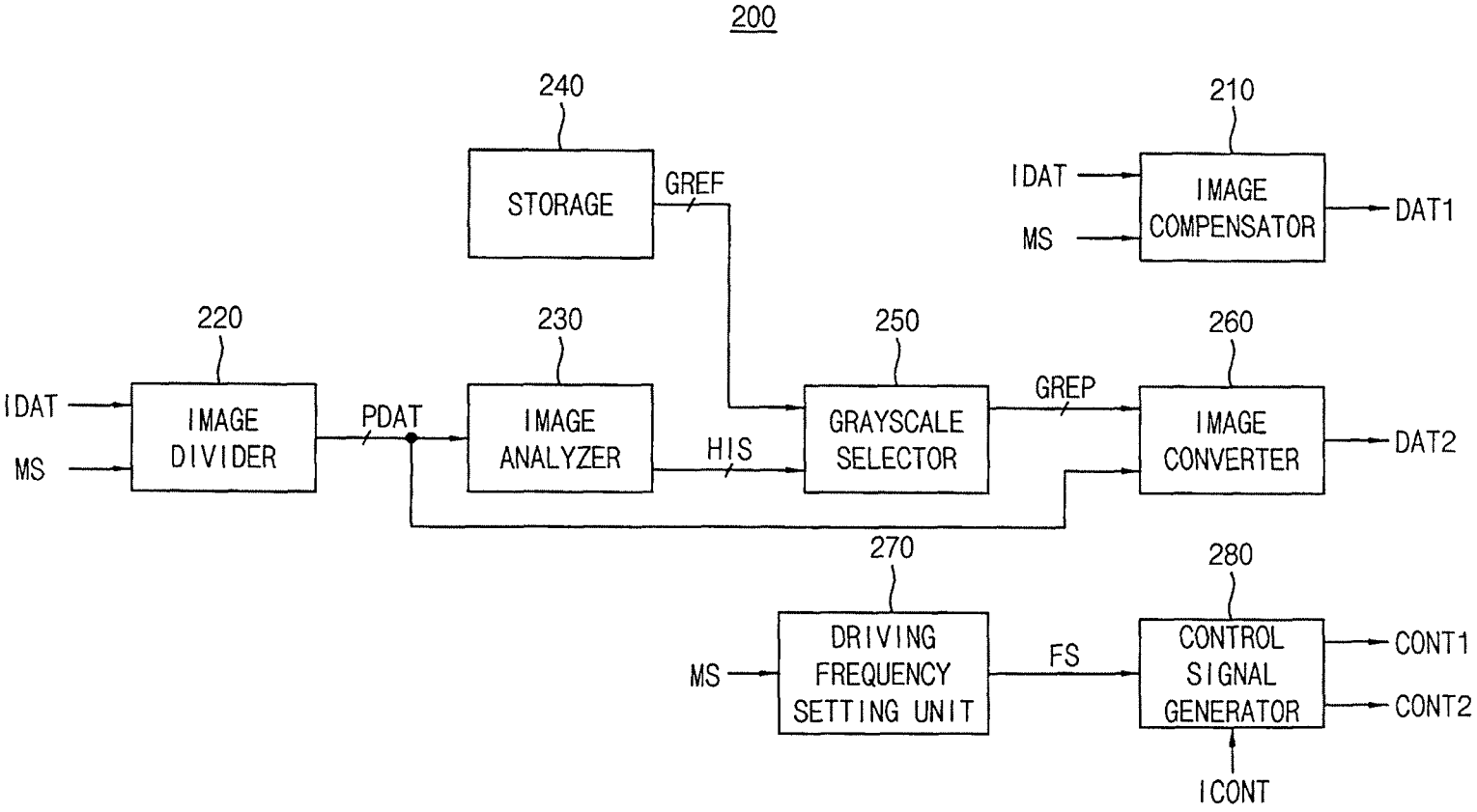
FIG. 3 is a block diagram illustrating a timing controller included in the display apparatus according to exemplary embodiments.

FIG. 3 is a block diagram illustrating a timing controller included in the display apparatus according to exemplary embodiments.

Referring to FIGS. 1 and 3, a timing controller 200 may include an image compensator 210, an image divider 220, an image analyzer 230, a storage device 240, a grayscale selector 250, an image converter 260, a driving frequency setting unit 270 and a control signal generator 280.

The image compensator 210 may receive the mode selection signal MS and the input image data IDAT. The image compensator 210 may generate the first output image data DAT1 based on the input image data IDAT in the first operation mode. The first output image data DAT1 may be image data that is substantially the same as the input image data IDAT or compensated image data that is generated by compensating the input image data IDAT. For example, the image compensator 210 may selectively perform image quality compensation, a spot compensation, an adaptive color correction (ACC), and/or a dynamic capacitance compensation (DCC) for the input image data IDAT to generate the first output image data DAT1.

The image divider 220 may receive the mode selection signal MS and the input image data IDAT. The image divider 220 may generate a plurality of partial image data PDAT by dividing the input image data IDAT in the second operation mode. Each of the plurality of partial image data PDAT may correspond to a respective one of a plurality of partial images partitioned from the first image. The number of the partial images and the number of the partial image data PDAT may be changed.

The image analyzer 230 may generate a plurality of grayscale histograms HIS based on the plurality of partial image data PDAT. The grayscale histogram may indicate a relationship between a plurality of grayscales and the number of pixels corresponding to the plurality of grayscales. For example, each of the partial image data PDAT may include a plurality of pixel data. Each of the grayscale histograms HIS may indicate, for example, the number of the pixel data corresponding to two hundred fifty six grayscales, which range from about 0 grayscale to about 255 grayscale.

The storage 240 may store a plurality of reference grayscales GREF. For example, the storage 240 may include, for example, at least one nonvolatile memory such as an erasable programmable read-only memory (EPROM), an electrically erasable programmable read-only memory (EEPROM), a flash memory, a phase change random access memory (PRAM), a resistance random access memory (RRAM), a magnetic random access memory (MRAM), a ferroelectric random access memory (FRAM), a nano floating gate memory (NFGM), a polymer random access memory (PoRAM), etc.

The plurality of reference grayscales GREF may be flicker free grayscales that allow the display panel 100 to operate in the low frequency mode without flicker. The plurality of reference grayscales GREF will be described in detail with reference to FIG. 7.

The grayscale selector 250 may select a plurality of representative grayscales GREP based on the plurality of grayscale histograms HIS and the plurality of reference grayscales GREF. As will be described with reference to FIG. 8, the plurality of representative grayscales GREP may be included in the plurality of reference grayscales GREF.

The image converter 260 may generate the second output image data DAT2 based on the plurality of partial image data PDAT and the plurality of representative grayscales GREP. The image converter 260 may convert each of the plurality of partial image data PDAT and may combine the plurality of converted partial image data to generate the second output image data DAT2.

The driving frequency setting unit 270 may generate a frequency signal FS indicating the driving frequency of the display panel 100 based on the mode selection signal MS. The driving frequency setting unit 270 may set the driving frequency of the display panel 100 as the first frequency in the first operation mode and may set the driving frequency of the display panel 100 as the second frequency in the second operation mode. For example, as described with reference to FIGS. 2A, 2B and 2C, the first frequency may be set to about 60 Hz, and the second frequency may be set to about 30 Hz, 20 Hz, etc.

The control signal generator 280 may receive the input control signal ICONT. The control signal generator 280 may generate the first control signal CONT1 for the gate driver 300 and the second control signal CONT2 for the data driver 400 based on the input control signal ICONT and the driving frequency of the display panel 100 (e.g., the frequency signal FS). The control signal generator 280 may output the first control signal CONTI to the gate driver 300 and may output the second control signal CONT2 to the data driver 400.

As described above, in the second operation mode, the image divider 220 may be enabled, and the image analyzer 230, the storage 240, the grayscale selector 250 and the image converter 260 may be also enabled. In the first operation mode, the image divider 220, the image analyzer 230, the storage 240, the grayscale selector 250 and the image converter 260 may be disabled. The image compensator 210 may be enabled in the first operation mode and may be disabled in the second operation mode.

In an exemplary embodiment, in FIG. 3, the image quality compensation, the spot compensation, the ACC, and/or the DCC for the input image data IDAT or the second output image data DAT2 may be selectively performed in the second operation mode. In other words, the image compensator 210 may be enabled in both the first operation mode and the second operation mode.

Figure 4:
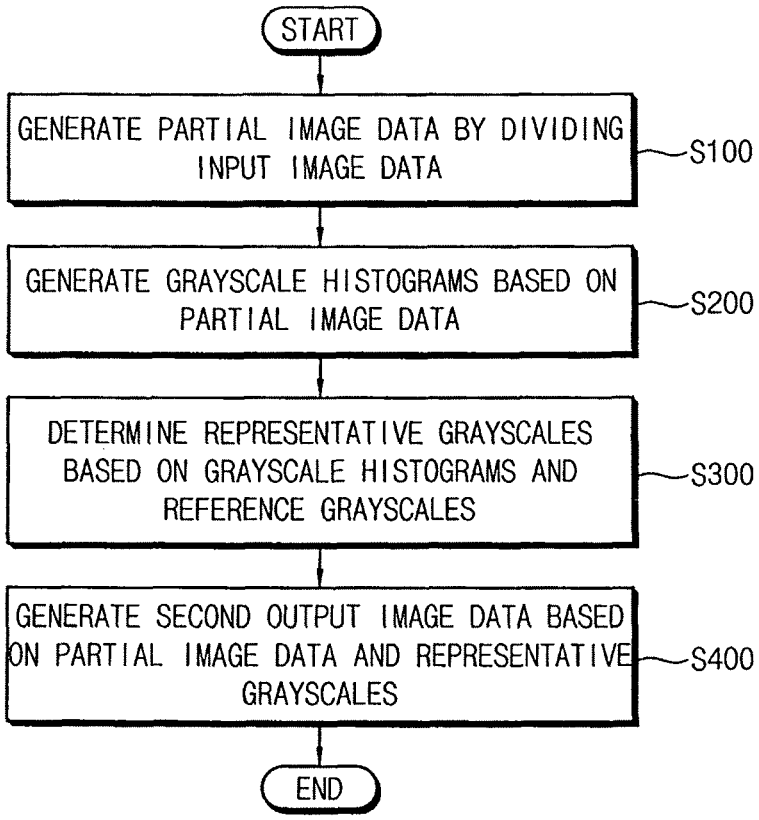
FIG. 4 is a flow chart illustrating an operation of the timing controller of FIG. 3.
Figure 5:
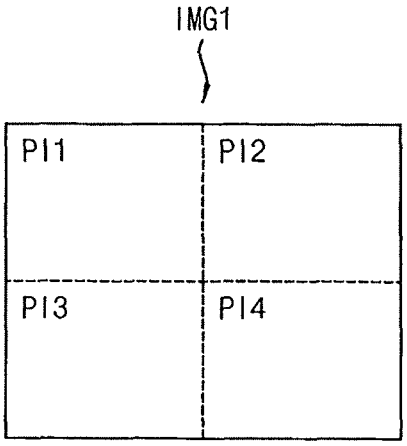
FIGS. 5, 6A, 6B, 6C, 6D, 7 and 8 are diagrams for describing the operation of the timing controller of FIG. 3.
Figure 9:
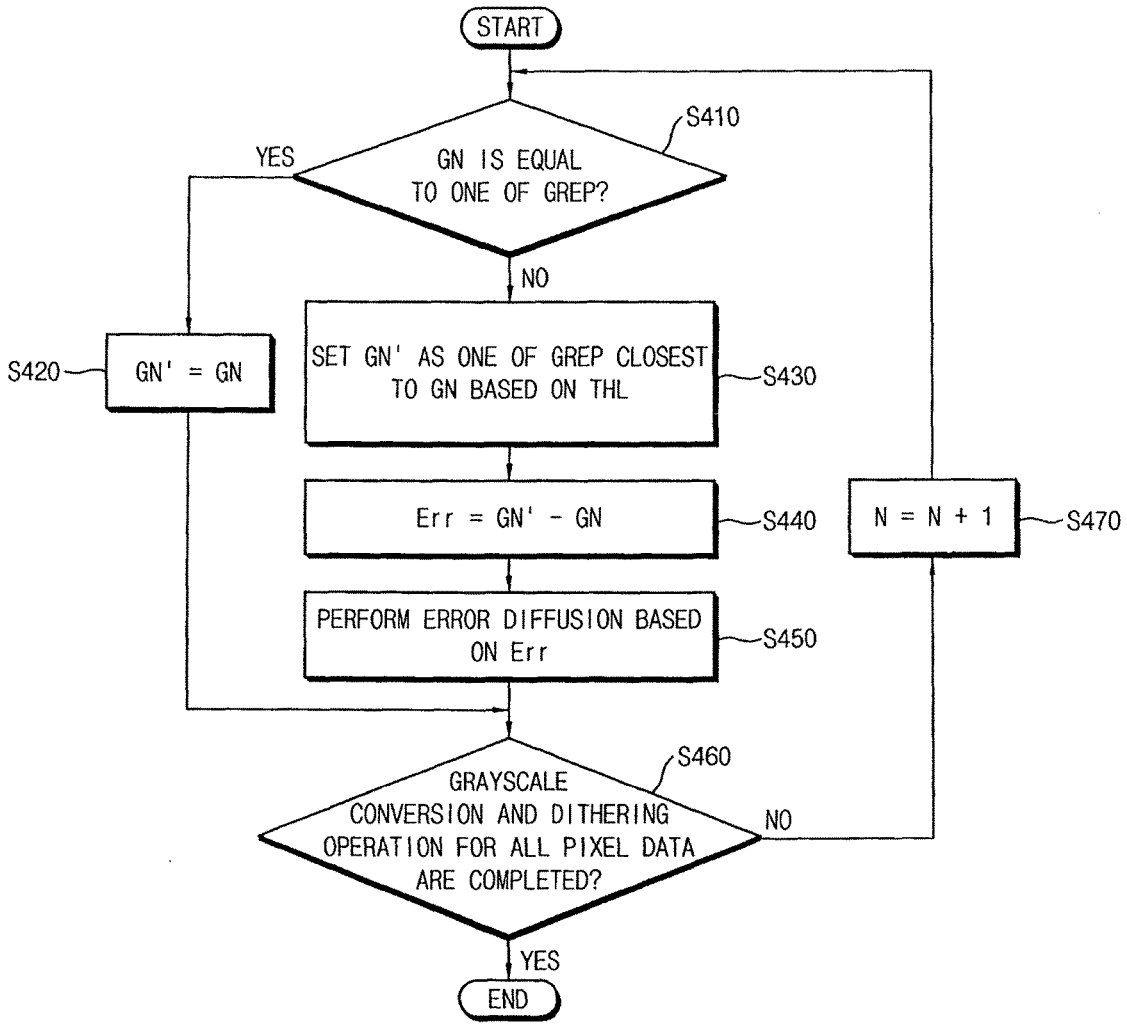
FIG. 9 is a flow chart illustrating an example of step S400 in FIG. 4.

FIG. 4 is a flow chart illustrating an operation of the timing controller of FIG. 3. FIGS. 5, 6A, 6B, 6C, 6D, 7 and 8 are diagrams for describing the operation of the timing controller of FIG. 3. FIG. 5 is a plan view illustrating an example of dividing an image. FIGS. 6A, 6B, 6C and 6D are graphs illustrating an example of the grayscale histograms HIS. FIG. 7 is a graph illustrating an example of the reference grayscales GREF. FIG. 8 is a table illustrating an example of the representative grayscales GREP. FIG. 9 is a flow chart illustrating an example of step S400 in FIG. 4.

Hereinafter, an operation of the timing controller 200 that generates the second output image data DAT2 in the second operation mode will be described in detail.

Referring to FIGS. 3, 4, 5, 6A, 6B, 6C, 6D, 7, 8 and 9, the image divider 220 may generate the plurality of partial image data PDAT by dividing the input image data IDAT in the second operation mode (step S100). For example, as illustrated in FIG. 5, an image IMG1 corresponding to the input image data IDAT (or corresponding to the first output image data DAT1) may be divided into first, second, third and fourth partial images PI1, PI2, PI3 and PI4. In other words, the image IMG1 (e.g., the first image) may include the first through fourth partial images PI1~PI4, and the image divider 220 may generate first, second, third and fourth partial image data corresponding to the first through fourth partial images PI1~PI4.

Although FIG. 5 illustrates the example in which the image IMG1 is divided into two-by-two partial images, the first image may be divided into I-by-J partial images, where I and J are natural numbers.

In an exemplary embodiment, the image IMG1 may be divided into six partial images. The image IMG1 may be divided by the image divider 220 into three segments along a horizontal direction and two segments along a vertical line. In other words, the image IMG1 (e.g., the first image) may include the first through sixth partial images PI1~PI6, and the image divider 220 may generate first, second, third, fourth, fifth and sixth partial image data corresponding to the first through sixth partial images PI1~PI6.

The image analyzer 230 may generate the plurality of grayscale histograms HIS based on the plurality of partial image data PDAT in the second operation mode (step S200). For example, the image analyzer 230 may generate a first grayscale histogram illustrated in FIG. 6A based on the first partial image data. The image analyzer 230 may generate a second grayscale histogram illustrated in FIG. 6B based on the second partial image data. The image analyzer 230 may generate a third grayscale histogram illustrated in FIG. 6C based on the third partial image data. The image analyzer 230 may generate a fourth grayscale histogram illustrated in FIG. 6D based on the fourth partial image data.

Although FIGS. 6A, 6B, 6C and 6D illustrate the example in which the partial images PI1~PI4 in the image IMG1 of FIG. 5 are represented by two hundred fifty six grayscales, which range from about 0 grayscale to about 255 grayscale, the partial images may be represented by M grayscales, where M is a natural number.

The plurality of reference grayscales GREF may be determined based on a characteristic of the display panel 100 in FIG. 1. For example, in a manufacturing process, test images having various grayscales may be displayed on the display panel 100, and flicker levels of the display panel 100 may be measured based on the test images. Thus, as illustrated in FIG. 7, a relationship between a plurality of grayscales and a plurality of flicker levels corresponding to the plurality of grayscales may be obtained. Based on the graph of FIG. 7, a minimum grayscale (e.g., about 0 grayscale) and flicker free grayscales may be selected as the plurality of reference grayscales GREF. The flicker free grayscales may allow the display panel 100 to have a flicker level lower than a reference flicker level RFLK (e.g., about 1.0) and may be grayscales between GREFA and GREFB in the graph of FIG. 7 (e.g., about 32 grayscale through about 162 grayscale). In other words, the flicker level of the display panel 100 may be lower than the reference flicker level RFLK when the display panel 100 displays an image only represented by the plurality of reference grayscales GREF.

Although FIG. 7 illustrates the example in which the reference flicker level RFLK is about 1.0 and the plurality of reference grayscales GREF include about 0 grayscale and about 32 grayscale through about 162 grayscale, the reference flicker level and the plurality of reference grayscales may be not limited thereto.

The grayscale selector 250 may determine the plurality of representative grayscales GREP based on the plurality of grayscale histograms HIS and the plurality of reference grayscales GREF in the second operation mode (step S300). For example, the grayscale selector 250 may determine first representative grayscales for the first partial image data based on the first grayscale histogram of FIG. 6A and the reference grayscales GREF obtained from the graph of FIG. 7. The grayscale selector 250 may determine second representative grayscales for the second partial image data based on the second grayscale histogram of FIG. 6B and the reference grayscales GREF. The grayscale selector 250 may determine third representative grayscales for the third partial image data based on the third grayscale histogram of FIG. 6C and the reference grayscales GREF. The grayscale selector 250 may determine fourth representative grayscales for the fourth partial image data based on the fourth grayscale histogram of FIG. 6D and the reference grayscales GREF.

In some exemplary embodiments, the grayscale selector 250 may select Z grayscales as the first representative grayscales, where Z is a natural number equal to or less than Y. The Z grayscales may indicate majority grayscales among the plurality of reference grayscales GREF in the first grayscale histogram. For example, the first grayscale histogram of FIG. 6A may include a large number of about 0 grayscale, about 32 grayscale, about 43 grayscale, about 81 grayscale, about 89 grayscale, about 130 grayscale, about 139 grayscale and about 162 grayscale among the reference grayscales GREF (e.g., about 0 grayscale and about 32 grayscale through about 162 grayscale). Thus, as illustrated in FIG. 8, about 0 grayscale, about 32 grayscale, about 43 grayscale, about 81 grayscale, about 89 grayscale, about 130 grayscale, about 139 grayscale and about 162 grayscale, which are the majority grayscales in the first grayscale histogram of FIG. 6A, may be selected as the first representative grayscales. The first representative grayscales may be included in the plurality of reference grayscales GREF. In other words, the first representative grayscales may be a subset of the reference grayscales GREF.

Figure 6A:
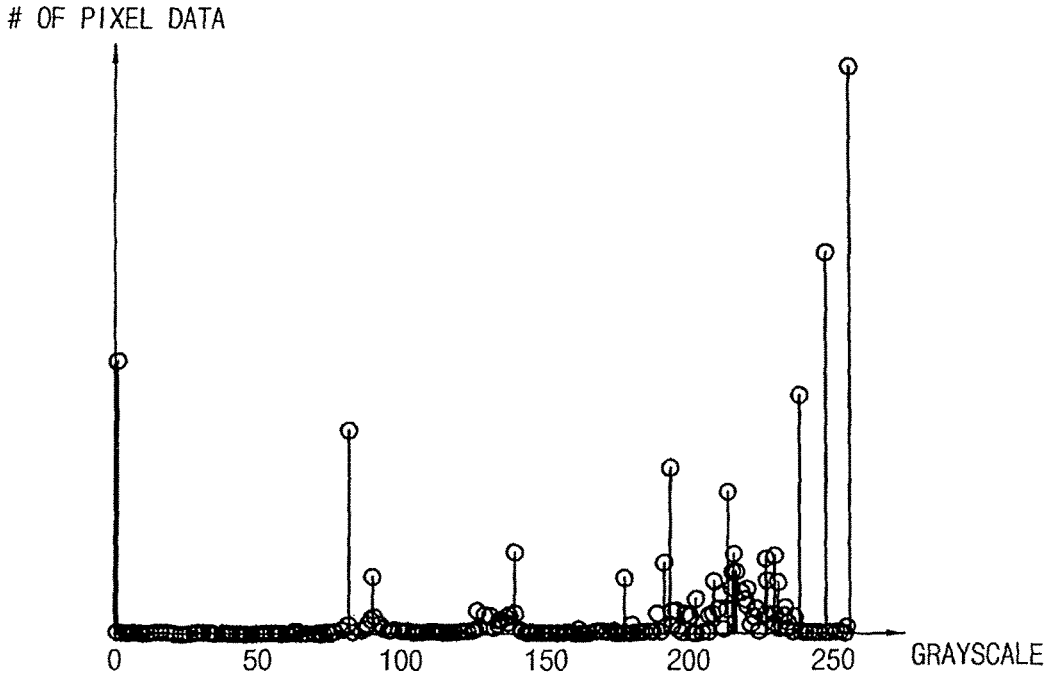
Figure 6B:
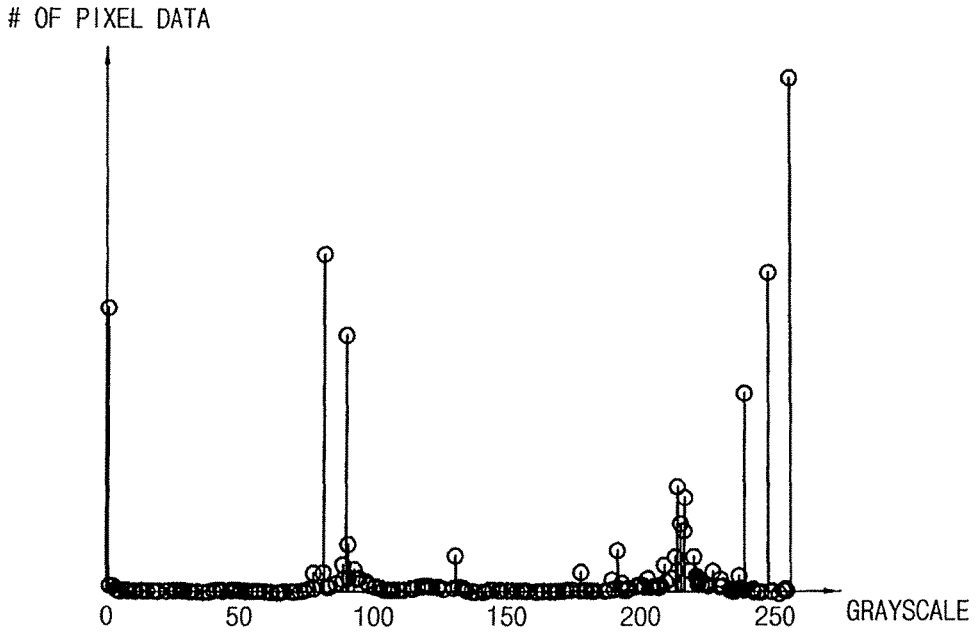
Figure 6C:
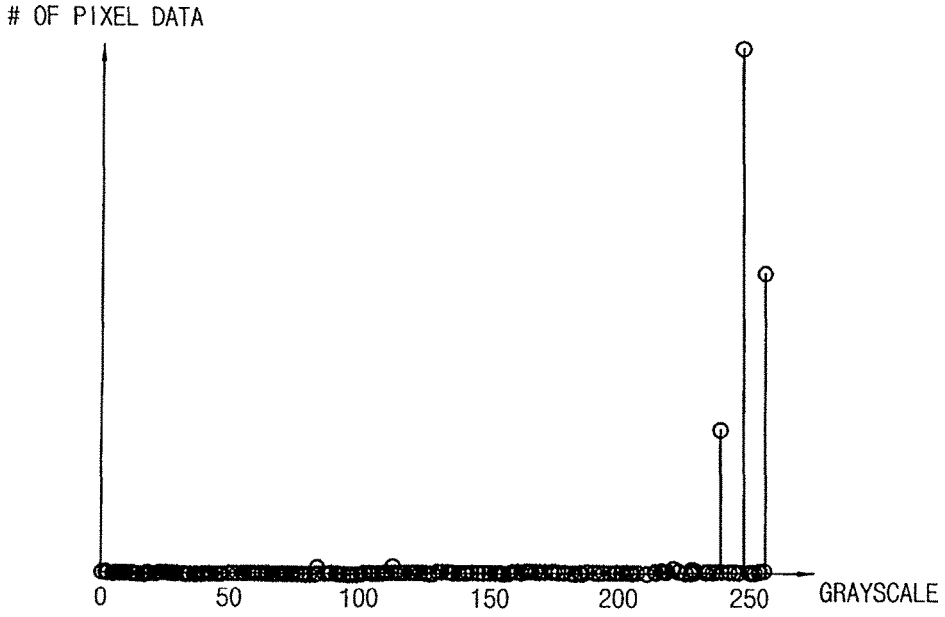
Figure 6D:
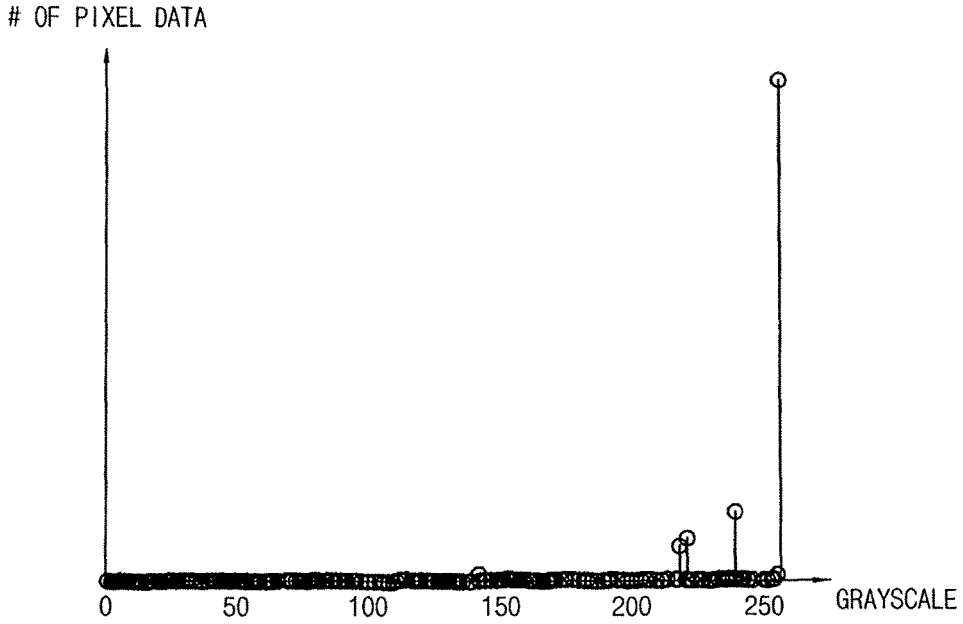
Figures 7, 8:
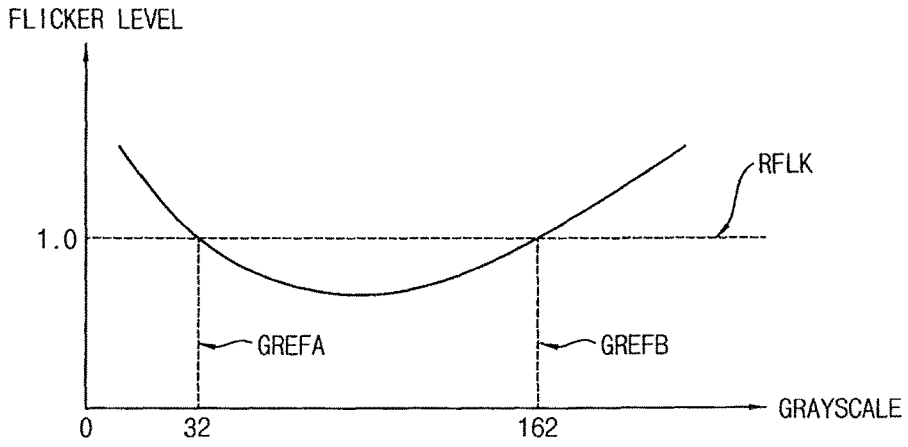

Similarly, about 0 grayscale, about 32 grayscale, about 43 grayscale, about 77 grayscale, about 81 grayscale, about 89 grayscale, about 130 grayscale and about 162 grayscale, which are majority grayscales among the plurality of reference grayscales GREF in the second grayscale histogram of FIG. 6B, and may be selected as the second representative grayscales. About 0 grayscale, about 32 grayscale, about 43 grayscale, about 83 grayscale, about 112 grayscale, about 128 grayscale, about 151 grayscale and about 162 grayscale, which are majority grayscales among the plurality of reference grayscales GREF in the third grayscale histogram of FIG. 6C, and may be selected as the third representative grayscales. About 0 grayscale, about 32 grayscale, about 43 grayscale, about 83 grayscale, about 90 grayscale, about 112 grayscale, about 141 grayscale and about 162 grayscale, which are majority grayscales among the plurality of reference grayscales GREF in the fourth grayscale histogram of FIG. 6D, and may be selected as the fourth representative grayscales.

The plurality of representative grayscales GREP may be substantially the same each other or may be different from each other depending on grayscale distributions of the partial images PI1~PI4. For example, some (e.g., about 0 grayscale, about 32 grayscale, about 43 grayscale, about 81 grayscale, about 89 grayscale, about 130 grayscale and about 162 grayscale) of the second representative grayscales may be included in the first representative grayscales, and others (e.g., about 77 grayscale) of the second representative grayscales may be not included in the first representative grayscales.

Although FIG. 8 illustrates the example in which eight representative grayscales are selected for one partial image, the number of selected representative grayscales may be not limited thereto.

The image converter 260 may generate the second output image data DAT2 based on the plurality of partial image data PDAT and the plurality of representative grayscales GREP in the second operation mode (step S400). For example, the image converter 260 may generate a first part of the second output image data DAT2 based on the first partial image data and the first representative grayscales illustrated in FIG. 8. The image converter 260 may generate a second part of the second output image data DAT2 based on the second partial image data and the second representative grayscales illustrated in FIG. 8. The image converter 260 may generate a third part of the second output image data DAT2 based on the third partial image data and the third representative grayscales illustrated in FIG. 8. The image converter 260 may generate a fourth part of the second output image data DAT2 based on the fourth partial image data and the fourth representative grayscales illustrated in FIG. 8. The image converter 260 may combine the first through fourth parts of the second output image data DAT2 to generate the second output image data DAT2.

In some exemplary embodiments, the image converter 260 may convert each of a plurality of grayscales for the first partial image data into a respective one of the first representative grayscales. For example, the image converter 260 may perform a grayscale conversion for the first partial image data and may perform a dithering operation to minimize a quantization error, which is caused by the grayscale conversion, between an input grayscale (e.g., an original grayscale) and an output grayscale (e.g., a converted grayscale).

The grayscale conversion and the dithering operation will be described in detail with reference to FIG. 9.

In FIG. 9, the image converter 260 may compare an original N-th grayscale GN with the first representative grayscales, where N is a natural number (step S410). The original N-th grayscale GN may be an original grayscale for N-th pixel data among a plurality of pixel data included in the first partial image data.

When the original N-th grayscale GN is substantially equal to one of the first representative grayscales (step S410: YES), the image converter 260 may set a converted N-th grayscale GN' for the N-th pixel data as the original N-th grayscale GN (step S420).

When the original N-th grayscale GN is different from all of the first representative grayscales (step S410: NO), the image converter 260 may set the converted N-th grayscale GN' for the N-th pixel data as one of the first representative grayscales, which is closest to the original N-th grayscale GN, based on threshold grayscales THL (step S430).

In some exemplary embodiments, the threshold grayscales THL may include middle grayscales, each of which is between two representative grayscales. For example, as illustrated in FIG. 8, when the first representative grayscales include about 0 grayscale, about 32 grayscale, about 43 grayscale, about 81 grayscale, about 89 grayscale, about 130 grayscale, about 139 grayscale and about 162 grayscale, the threshold grayscales THL for the first representative grayscales may include about 16 grayscale, about 37.5 grayscale, about 62 grayscale, about 85 grayscale, about 109.5 grayscale, about 134.5 grayscale and about 150.5 grayscale.

The image converter 260 may perform an error calculation by subtracting the original N-th grayscale GN from the converted N-th grayscale GN' to generate an error grayscale Err for the N-th pixel data (step S440). For example, when the converted N-th grayscale GN' is about 32 grayscale and when the original N-th grayscale GN is about 20 grayscale, the error grayscale Err may be about 10 grayscale.

The image converter 260 may perform an error diffusion based on the error grayscale Err (step S450). For example, the error grayscale Err may be spread to neighboring pixels that are adjacent to a pixel operating based on the N-th pixel data.

In some exemplary embodiments, the steps S440 and S450 may be performed based one of a Floyd-Steinberg dithering algorithm, a Jarvis, Judice and Ninke dithering algorithm, a Stucki dithering algorithm and a Atkinson dithering algorithm. The Floyd-Steinberg dithering algorithm, Jarvis, Judice and Ninke dithering algorithm, Stucki dithering algorithm and Atkinson dithering algorithm are widely known to those skilled in the art, and thus will be not described in detail.

When the grayscale conversion and the dithering operation for each of the pixel data of the plurality of pixel data included in the first partial image data are not completed (step S460: NO), the number N increases (step S470), and the steps S410, S420, S430, S440, S450 and S460 may be repeated for each of the plurality of pixel data included in the first partial image data other than first through N-th pixel data. The steps may be repeated until the grayscale conversion and the dithering operation for each of the pixel data of the plurality of pixel data included in the first partial image data are completed.

When the grayscale conversion and the dithering operation for each of the pixel data of the plurality of pixel data included in the first partial image data are completed (step S460: YES), the data conversion for the first partial image data may be terminated, and the image converter 260 may generate the first part of the second output image data DAT2 corresponding to the first partial image data.

Similarly, the image converter 260 may convert each of a plurality of grayscales for the second partial image data into a respective one of the second representative grayscales. The image converter 260 may convert each of a plurality of grayscales for the third partial image data into a respective one of the third representative grayscales. The image converter 260 may convert each of a plurality of grayscales for the fourth partial image data into a respective one of the fourth representative grayscales.

Figure 10:
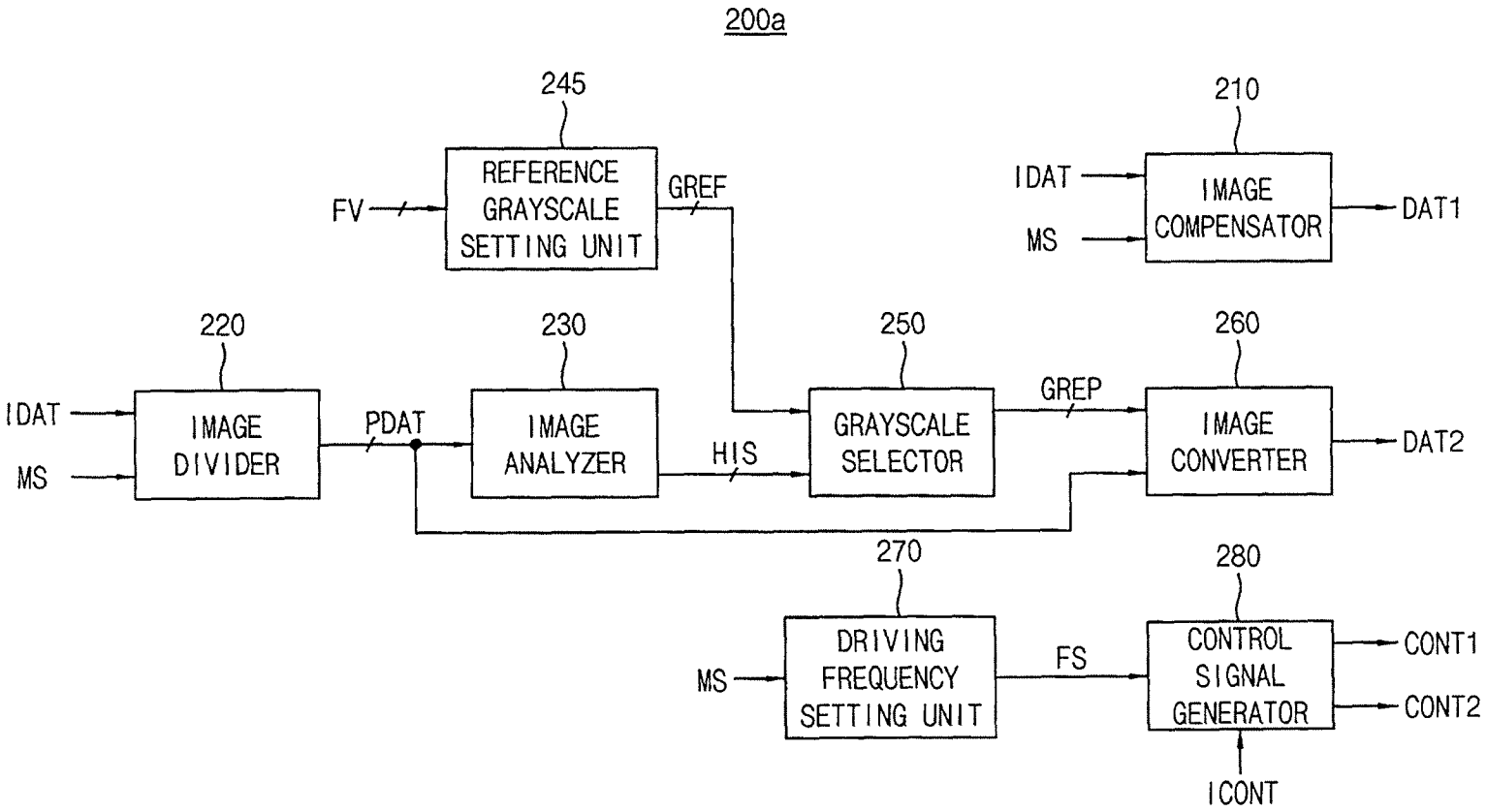
FIG. 10 is a block diagram illustrating a timing controller included in the display apparatus according to exemplary embodiments.
Figure 11:
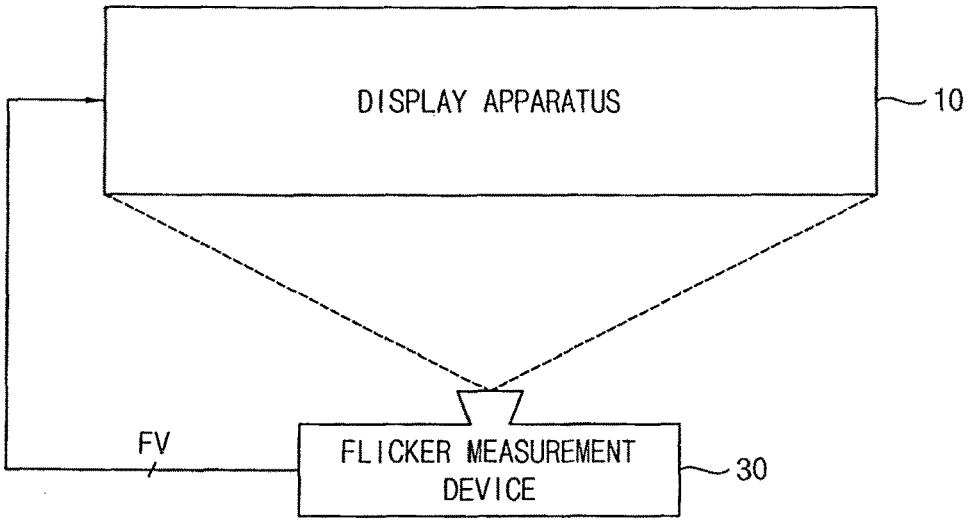
FIG. 11 is a block diagram illustrating a flicker measurement device to measure flicker levels of the display apparatus according to exemplary embodiments.

FIG. 10 is a block diagram illustrating a timing controller included in the display apparatus according to exemplary embodiments. FIG. 11 is a block diagram illustrating a flicker measurement device to measure flicker levels of the display apparatus according to exemplary embodiments.

The display apparatus 10 of FIG. 11 according to exemplary embodiments may display the low quality image based on the relatively low driving frequency and the second output image data DAT2 in the second operation mode, and thus may have a relatively low power consumption.

Referring to FIGS. 1, 10 and 11, a timing controller 200*a* may include an image compensator 210, an image divider 220, an image analyzer 230, a reference grayscale setting unit 245, a grayscale selector 250, an image converter 260, a driving frequency setting unit 270 and a control signal generator 280.

The timing controller 200*a* of FIG. 10 may be substantially the same as the timing controller 200 of FIG. 3, except that the storage 240 in FIG. 3 is replaced with the reference grayscale setting unit 245 in FIG. 10. The image compensator 210, the image divider 220, the image analyzer 230, the grayscale selector 250, the image converter 260, the driving frequency setting unit 270 and the control signal generator 280 in FIG. 10 may be substantially the same as the image compensator 210, the image divider 220, the image analyzer 230, the grayscale selector 250, the image converter 260, the driving frequency setting unit 270 and the control signal generator 280 in FIG. 3, respectively.

The reference grayscale setting unit 245 may determine the plurality of reference grayscales GREF based on a plurality of flicker levels FV obtained from an external flicker measurement device 30. For example, a relationship between a plurality of grayscales and a plurality of flicker levels corresponding to the plurality of grayscales may be obtained in real time by displaying test images having various grayscales on the display panel 100 and by measuring flicker levels of the display panel 100 based on the test images. The plurality of reference grayscales GREF may be determined based on the relationship (e.g., the graph of FIG. 7) and a reference flicker level (e.g., RFLK in FIG. 7).

In some exemplary embodiments, the display apparatus 10 may be temporarily connected to the flicker measurement device 30 and may receive the plurality of flicker levels FV from the flicker measurement device 30. For example, the display apparatus 10 may communicate with the flicker measurement device 30 using a protocol between communication interfaces, based on, for example, an Inter-Integrated Circuit (I2C) interface. When the determination of the reference grayscales GREF is completed, the flicker measurement device 30 may be separated from the display apparatus 10.

Although not illustrated in FIG. 10, the plurality of reference grayscales GREF may be provided with the input image data IDAT. For example, the reference grayscales GREF may be inserted into a header of the input image data IDAT.

Figure 12:
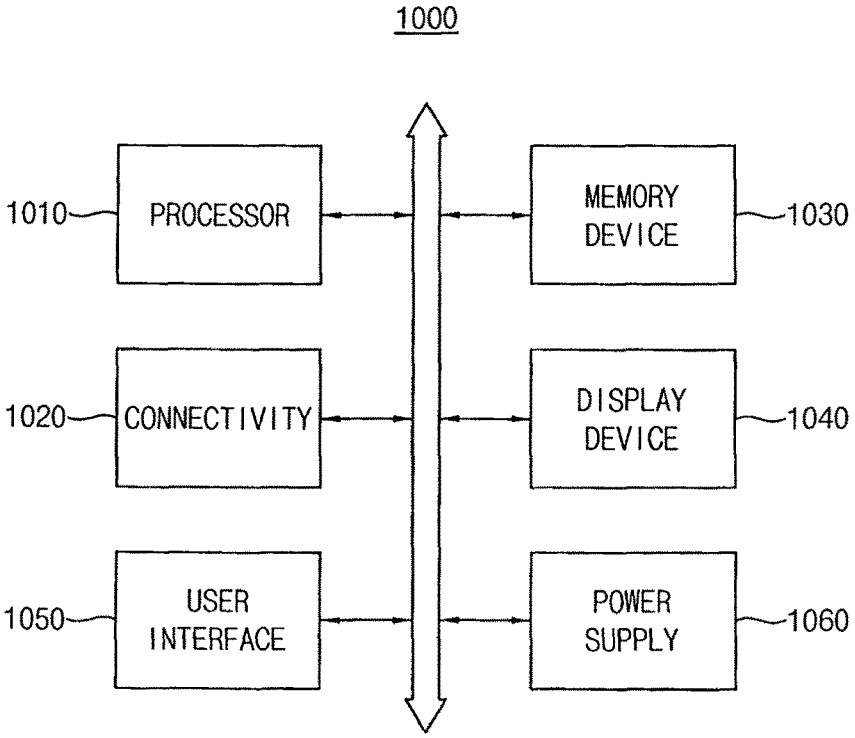
FIG. 12 is a block diagram illustrating an electronic system according to exemplary embodiments.
Figure 13:
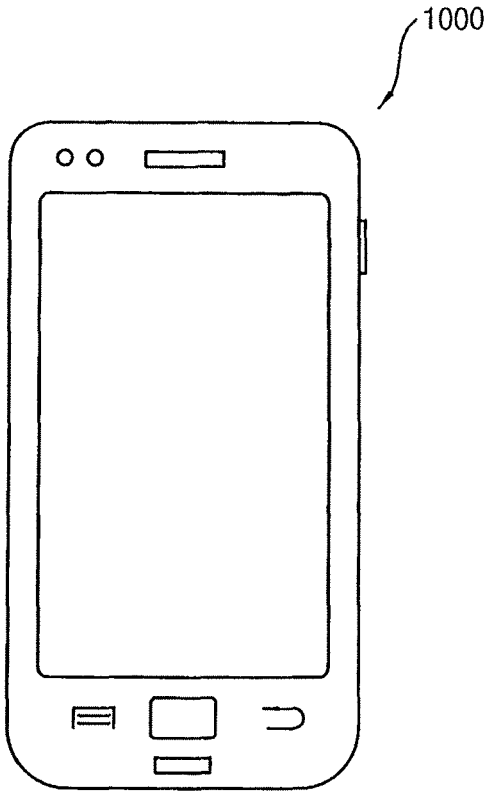
FIG. 13 is a diagram illustrating an example in which the electronic system of FIG. 12 is implemented as a portable electronic device.

FIG. 12 is a block diagram illustrating an electronic system according to exemplary embodiments. FIG. 13 is a diagram illustrating an example in which the electronic system of FIG. 12 is implemented as a portable electronic device.

Referring to FIG. 12, an electronic system 1000 includes a processor 1010, a connectivity unit 1020, a memory device 1030, a display apparatus 1040, a user interface 1050 and a power supply 1060. In some exemplary embodiments, the electronic system 1000 may be any portable electronic device, such as a mobile phone, a smart phone, a tablet computer, a laptop computer, a personal digital assistants (PDA), a portable multimedia player (PMP), a digital camera, a portable game console, a music player, a camcorder, a video player, a navigation system, etc.

The processor 1010 may execute applications, such as an internet browser, a game application, a video player application, etc. For example, the processor 1010 may be a central processing unit (CPU), an application processor (AP), etc.

In some exemplary embodiments, the processor 1010 may include a single processor core or a plurality of processor cores. For example, the processor 1010 may be a multi-core processor, such as a dual-core processor, a quad-core processor, a hexa-core processor, etc. In some exemplary embodiments, the processor 1010 may further include a cache memory located inside or outside the processor 1010.

The connectivity unit 1020 may perform wired or wireless communication with an external device. For example, the connectivity unit 1020 may perform a USB communication, an Ethernet communication, a near field communication (NFC), a radio frequency identification (RFID) communication, a mobile telecommunication, a memory card communication, wireless internet, wireless fidelity (Wi-Fi), global positioning system (GPS), Bluetooth (BT), global system for mobile communication (GSM), general packet radio system (GPRS), wideband code division multiple access (WCDMA), high speed uplink/downlink packet access (HSxPA), etc. The connectivity unit 1020 may include a baseband chipset.

The memory device 1030 may store an instruction/data processed by the processor 1010, may serve as a working memory, or may store a boot image for booting the electronic system 1000. For example, the memory device 1030 may include at least one volatile memory, such as a dynamic random access memory (DRAM), a static random access memory (SRAM), etc., and/or at least one nonvolatile memory, such as an EPROM, an EEPROM, a flash memory, a PRAM, a RRAM, a MRAM, a FRAM, a NFGM, a PoRAM, etc.

The display apparatus 1040 may be the display apparatus 10 of FIG. 1, and an operation of the display apparatus 1040 may be controlled by the processor 1010. For example, the display apparatus 1040 may include a display panel 100 in FIG. 1 and a timing controller 200 in FIG. 1 and may be implemented and may operate based on the example described with reference to FIGS. 2 through 11. The display apparatus 1040 may display the high quality image based on the relatively high driving frequency and the first output image data DAT1 in the first operation mode, and may display the low quality image based on the relatively low driving frequency and the second output image data DAT2 in the second operation mode (e.g., in the low power mode). Thus, the display apparatus 1040 and the electronic system 1000 may have low power consumption.

In some exemplary embodiments, the processor 1010 may generate the mode selection signal MS that selectively enables the first operation mode or the second operation mode to apply the mode selection signal MS to the timing controller 200. In some exemplary embodiments, to additionally reduce the power consumption after the second operation mode is enabled, a part of the processor cores in the processor 1010 may not operate, luminance of the display apparatus 1040 may be reduced, and/or the number of applications (e.g., softwares or programs) executed by the processor 1010 may be reduced.

The selection of the mode indicated by the mode selection signal MS may be automatic or manual. For example, a processor of the device may automatically change the mode selection signal MS based on a remaining charge contained is the device's battery, a current uptime of the device and/or a projected remaining operating time based on the remaining charge contained is the device's battery. The selection of the mode selection signal MS may be performed by a user of the device or based on a schedule set by the user of the device.

The user interface 1050 may include at least one input device, such as a keypad, a touch screen, a keyboard, a mouse, a microphone, etc., and at least one output device, such as a speaker, etc. The power supply 1060 may supply power to the electronic system 1000. In some exemplary embodiments, the electronic system 1000 may further include a camera image processor (CIS) storage device, such as a memory card, a solid state drive (SSD), a CD-ROM, etc.

According to exemplary embodiments, the electronic system 1000 and/or components of the electronic system 1000 may be packaged in various forms, such as a package on package (PoP), a ball grid arrays (BGA), a chip scale packages (CSP), a plastic leaded chip carrier (PLCC), a plastic dual in-line package (PDIP), a die in waffle pack, a die in wafer form, a chip on board (COB), a ceramic dual in-line package (CERDIP), a plastic metric quad flat pack (MQFP), a thin quad flat pack (TQFP), a small outline IC (SOIC), a shrink small outline package (SSOP), a thin small outline package (TSOP), a system in package (SIP), a multi chip package (MCP), a wafer-level fabricated package (WFP), or a wafer-level processed stack package (WSP).

Although the exemplary embodiments are described based on the examples of specific frequencies, specific grayscales and the specific number of partial images, the exemplary embodiments will be employed to an example in which the display panel operates based on any driving frequency, any grayscales are set as the representative grayscales, and/or an image displayed on the display panel is divided into any number of the partial images.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a display panel; and a timing controller configured to, in a first operation mode, generate first output image data based on input image data and set a driving frequency of the display panel as a first frequency, the timing controller configured to, in a second operation mode, convert the input image data into second output image data and set the driving frequency of the display panel as a second frequency lower than the first frequency, wherein the display panel displays a first image based on the first frequency and the first output image data in the first operation mode, the first image being represented by X grayscales, where X is a natural number equal to or greater than two, wherein the display panel displays a second image based on the second frequency and the second output image data in the second operation mode, the second image being represented by Y grayscales, where Y is a natural number less than X and the Y grayscales are based on a plurality of reference grayscales.

2. The display apparatus of claim 1, wherein the display panel displays the second output image data based on a frame masking driving (FMD) scheme where second frames of the input image data are blocked from the display.

3. The display apparatus of claim 2, further comprising:

a data driver configured to generate a plurality of data voltages based on one of the first output image data and the second output image data and to apply the plurality of data voltages to the display panel.

4. The display apparatus of claim 2, further comprising:

a gate driver configured to generate a plurality of gate signals based on one of the first output image data and the second output image data and to apply the plurality of gate signals to the display panel.

5. The display apparatus of claim 1, wherein the timing controller includes:

an image compensator configured to generate the first output image data based on the input image data in the first operation mode;

an image divider configured to generate a plurality of partial image data by dividing the input image data in the second operation mode, each frame of the input image data is divided into a plurality of partial image data;

an image analyzer configured to generate a plurality of grayscale histograms based on each partial image data of the plurality of partial image data;

a grayscale selector configured to determine a plurality of representative grayscales for each partial image data of the plurality of partial image data based on the grayscale histograms for each partial image data and the plurality of reference grayscales; and an image converter configured to generate the second output image data based on the plurality of partial image data and the plurality of representative grayscales.

6. The display apparatus of claim 5, wherein a flicker level of the display panel is lower than a reference flicker level when the display panel displays an image represented by the plurality of reference grayscales, wherein the plurality of representative grayscales are included in the plurality of reference grayscales.

7. The display apparatus of claim 5, wherein the plurality of partial image data include a first partial image, the image divider generates first partial image data corresponding to the first partial image, the image analyzer generates a first grayscale histogram based on the first partial image data, the grayscale selector determines first representative grayscales based on the first grayscale histogram and the plurality of reference grayscales, and the image converter generates a first part of the second output image data based on the first partial image data and the first representative grayscales.

8. The display apparatus of claim 1, wherein the plurality of partial image data include a second partial image, the image divider generates second partial image data corresponding to the second partial image, the image analyzer generates a second grayscale histogram based on the second partial image data, the grayscale selector determines second representative grayscales based on the second grayscale histogram and the plurality of reference grayscales, and the image converter generates a second part of the second output image data based on the second partial image data and the second representative grayscales, wherein some of the second representative grayscales are included in the first representative grayscales, and others of the second representative grayscales are not included in the first representative grayscales.

9. The display apparatus of claim 5, wherein the grayscale selector selects Z grayscales as the representative grayscales for each partial image data of the plurality of partial image data, where Z is a natural number equal to or less than Y, the Z grayscales indicating majority grayscales among the plurality of reference grayscales in the grayscale histogram for each partial image data of the plurality of partial image data, wherein the image converter converts each of a plurality of grayscales for each partial image data of the plurality of partial image data into a respective one of the representative grayscales for each partial image data of the plurality of partial image data.

10. The display apparatus of claim 5, wherein the timing controller further includes:

a storage device configured to store the plurality of reference grayscales.

11. The display apparatus of claim 5, wherein the timing controller further includes:

a reference grayscale setting unit configured to determine the plurality of reference grayscales based on flicker levels obtained from an external flicker measurement device.

12. The display apparatus of claim 1, wherein the timing controller further includes:

a driving frequency setting unit configured to set the driving frequency of the display panel as the first frequency in the first operation mode and set the driving frequency of the display panel as the second frequency in the second operation mode.

13. The display apparatus of claim 1, wherein the timing controller receives a mode selection signal that selectively enables the first operation mode or the second operation mode.

14. A method for operating a timing controller comprising:

receiving an input image data and a mode selection signal;

selecting one of a first and a second operation mode based on the mode selection signal;

wherein a first operation mode comprises, generating a first output image data based on the input image data in the first operation mode;

wherein the first output image data may be image data that is substantially the same as the input image data;

wherein a second operation mode comprises;

generating a partial image data by dividing input image data;

generating grayscale histograms based on partial image data;

determining representative grayscales based on grayscale histograms and reference grayscales;

generating second output image data based on partial image data and representative grayscales;

generating a frequency signal indicating a driving frequency of a display panel based on the mode selection signal;

receiving an input control signal; and generating a first control signal for a gate driver and a second control signal for a data driver based on the input control signal.

15. The method of claim 14, wherein the second operation mode further comprises;

blocking, based on a frame masking driving (FMD) scheme, every second frame of the input image data; and setting the driving frequency of the display panel to be a reciprocal of a period of two successive image frames.

16. The method of claim 14, wherein the second operation mode further comprises;

blocking, based on a frame masking driving (FMD) scheme, every second and third frame of the input image data; and setting the driving frequency of the display panel to be a reciprocal of a period of three successive image frames.

* * * * *